United States Patent [19]

Baker

[11] Patent Number: 4,747,516

[45] Date of Patent: May 31, 1988

[54] SOFT DRINK MAKER

[75] Inventor: Chester L. Baker, Sparks, Nev.

[73] Assignee: Liquid Motion Industries, Co., Reno, Nev.

[21] Appl. No.: 812,862

[22] Filed: Dec. 23, 1985

[51] Int. Cl.[4] ..... B67D 5/56

[52] U.S. Cl. ..... 222/129.1; 250/223 B; 141/140

[58] Field of Search ..... 222/640, 641, 639, 132, 222/145, 144.5, 129.3, 129.4, 148, 52, 129.1; 251/129.01, 129.04; 340/555, 568; 141/138, 140, 156, 13, 192; 250/221, 222.1, 223 B, 222.2

[56] References Cited

U.S. PATENT DOCUMENTS

| | | | |
|---|---|---|---|
| 2,415,178 | 2/1947 | Hurley, Jr. | 250/222.1 |
| 2,727,670 | 12/1955 | Shore | 251/129.04 |
| 2,951,618 | 9/1960 | Aldecoa | 141/156 |
| 3,195,779 | 7/1965 | Nicko | 222/129.1 |
| 3,409,176 | 11/1968 | Krause | 222/641 |
| 3,777,937 | 12/1973 | Buck | 222/641 |
| 3,805,999 | 4/1974 | Syverson | 222/129.4 |
| 3,932,763 | 1/1976 | Weinstein | 250/223 B |
| 4,162,028 | 7/1979 | Reichenberger | 222/129.4 |
| 4,211,342 | 7/1980 | Jamgochian | 222/129.4 |
| 4,282,987 | 8/1981 | Thomas et al. | 222/641 |
| 4,469,150 | 9/1984 | Grimaldi | 250/223 B |
| 4,487,333 | 12/1984 | Pounder et al. | 222/129.4 |
| 4,590,974 | 5/1986 | Mathews | 222/461 |

FOREIGN PATENT DOCUMENTS

| | | | |
|---|---|---|---|
| 845518 | 6/1970 | Canada | 222/129.1 |
| 2137520 | 10/1984 | United Kingdom | 222/129.4 |
| 2146621 | 4/1985 | United Kingdom | 222/640 |

*Primary Examiner*—Joseph J. Rolla
*Assistant Examiner*—Kenneth Noland
*Attorney, Agent, or Firm*—Lothrop & West

[57] ABSTRACT

A soft drink maker has a supply of soda water and various flavors housed in a cabinet. A user puts a container in a selected station on the cabinet and selects the size and flavor of the drink to be made and starts the machine. The machine senses the presence of the container in the station, dispenses soda water into the container in two measured and consecutive quantities, and dispenses into the container a measured quantity of the selected flavor syrup between the consecutive in-flows of soda water. Upon removal of the container from the station, the operation can be repeated. Various electrical interlocks make sure the proper sequence or cycle is followed.

2 Claims, 6 Drawing Sheets

SEE FIG-7
SEE FIG-8
SEE FIG-8
A
B
C
D
E
F
G
H

SEE FIG-7
SEE FIG-8
K
L
O
N
M
429
381
494
544

SOFT DRINK MAKER

BRIEF SUMMARY OF THE INVENTION

A soft drink maker includes a cabinet having a water supply, preferably carbonated, and having a number of differently flavored syrups. A container station on the cabinet is spaced below a nozzle. A sensor determines the presence of a container at the station. The user can manually preselect the size of a soft drink to be dispensed and can select the syrup flavor to be used and can start the dispensing operation. From the nozzle a stream of soda water issues into the container. This stream is stopped when an initial portion has been dispensed. From the nozzle then issues a stream of the selected syrup, which is stopped when a measured portion has been dispensed. Finally, a second stream of soda water issues from the nozzle and is stopped after a measured amount has been discharged. The so-filled container is then taken from the station, making the device available for another cycle of operation.

The drink maker is controlled by an electronic network responsive to various manual push buttons and to an electric eye. Various electro-mechanical valves are programmed on a time basis for dispensing a related flavor syrup and a chosen amount of soda water in a predetermined sequence.

DETAILED DESCRIPTION

While the disclosure herein is generally referred to as a soft drink maker, it is useful in mixing various liquids together and can be utilized for alcoholic beverages, as well as for other fluids, but the principal object of the invention is to provide a structure which can be utilized in general food stores, supermarkets and the like by anyone who is able to operate the controls. In many instances, the machine is arranged to be operated only after the deposit of coins, but that is not part of the present invention. Since coin-operated devices are well known, that feature is simply alluded to without being shown or described. Also, the present device can be arranged with any desired number of individual stations, from one up to a relatively large number, but simply as an example, the machine is shown herein as having four individual stations so that four customers can utilize the machine simultaneously.

Figure 1:
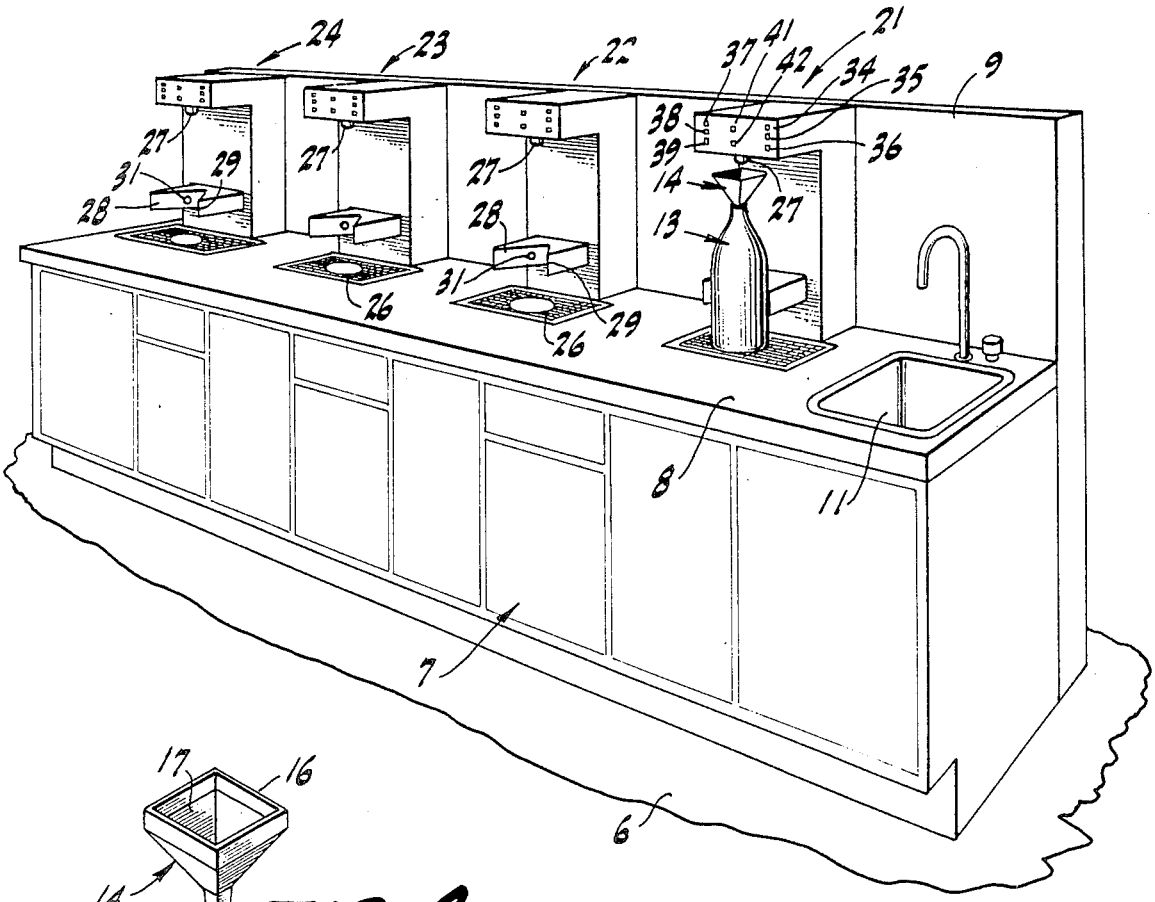
FIG. 1 is a perspective of a four-station soft drink maker constructed pursuant to the invention.
Figure 4:
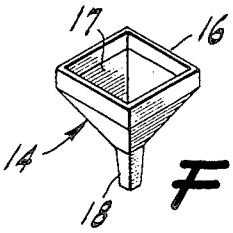
FIG. 4 is an isometric view of a preferred form of funnel utilized with the soft drink maker.
Figure 3:
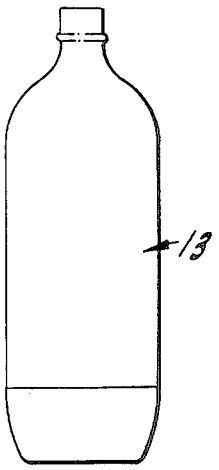
FIG. 3 is a side elevation of a typical container used in connection with the maker.
Figure 2:
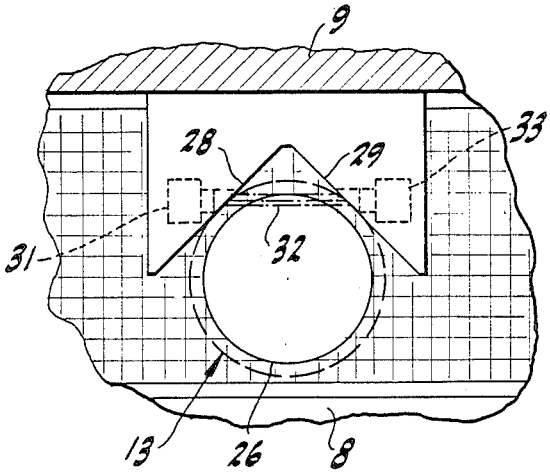
FIG. 2 is a detail showing in plan a portion of one station of the soft drink maker.
Figure 5:
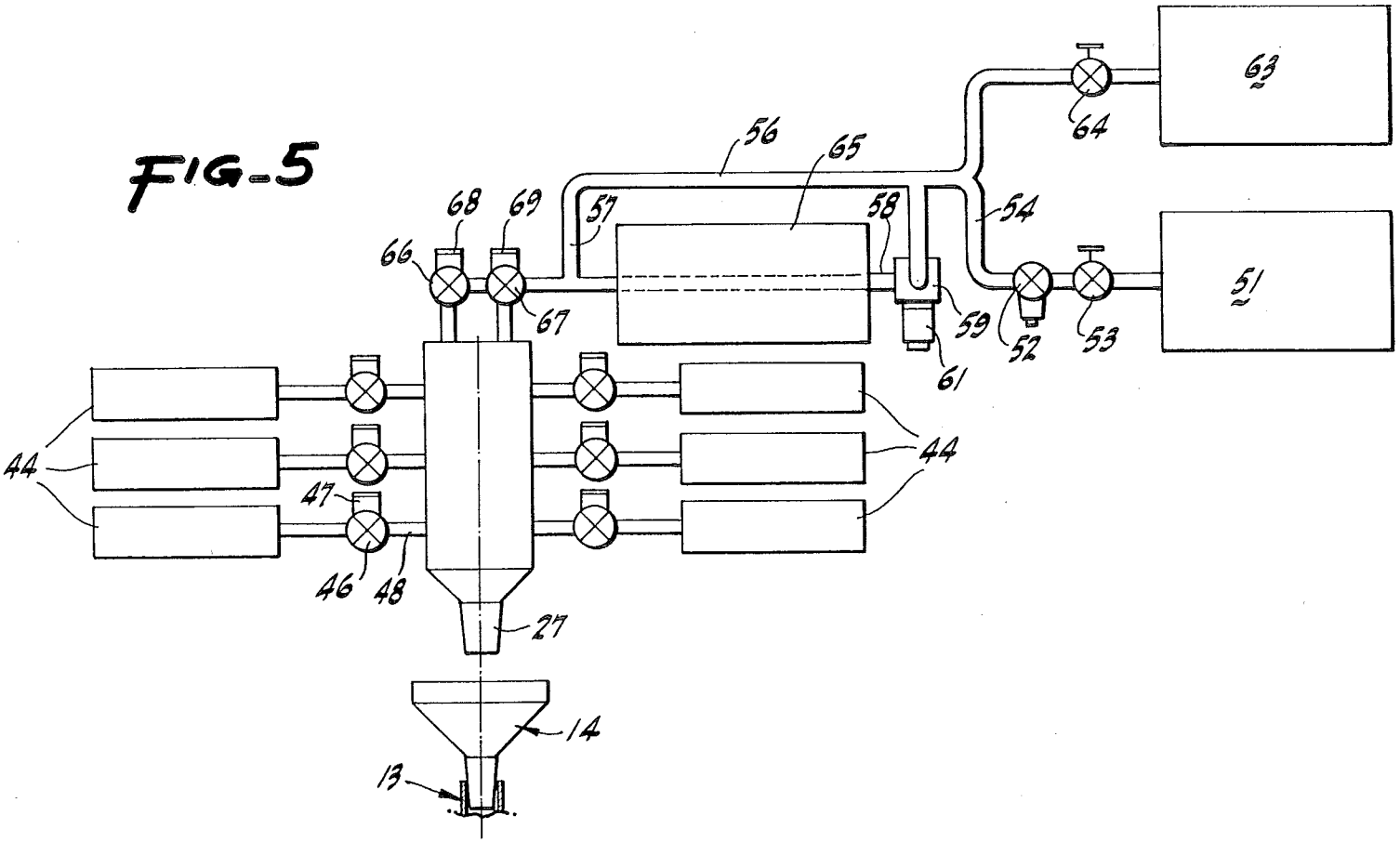
FIG. 5 is a diagram showing schematically the arrangement of the principal, mechanically working parts of the soft drink maker.
Figure 6:
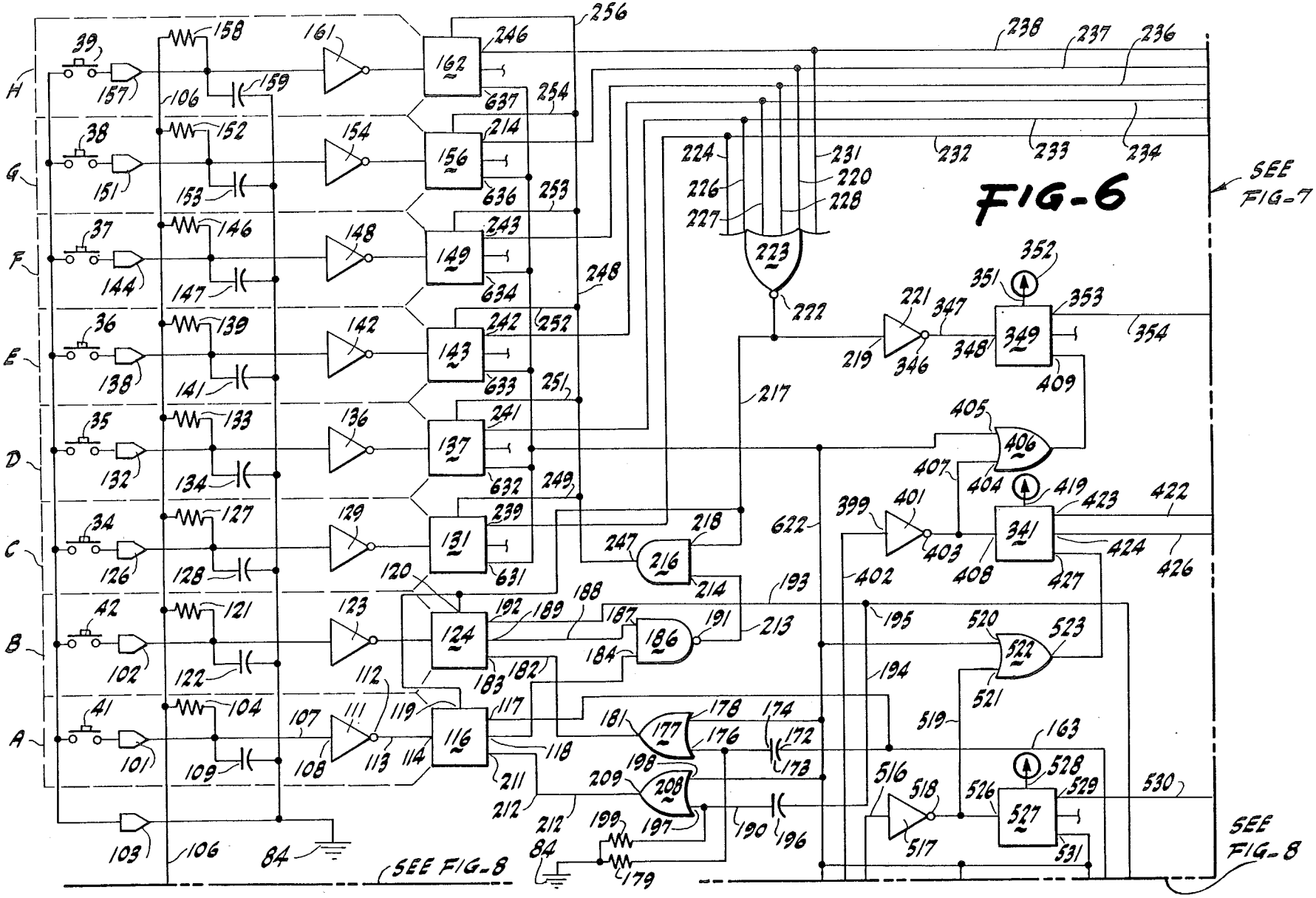
FIGS. 6, 7, 8 and 9 are respectively portions of a wiring diagram of the principal, electrically working parts of the structure. The diagram is completed by placing FIG. 6 in the upper left-hand corner, FIG. 7 in the upper right-hand corner, FIG. 8 in the lower left-hand corner, and FIG. 9 in the lower right-hand corner, making a continuous, composite drawing.
Figure 7:
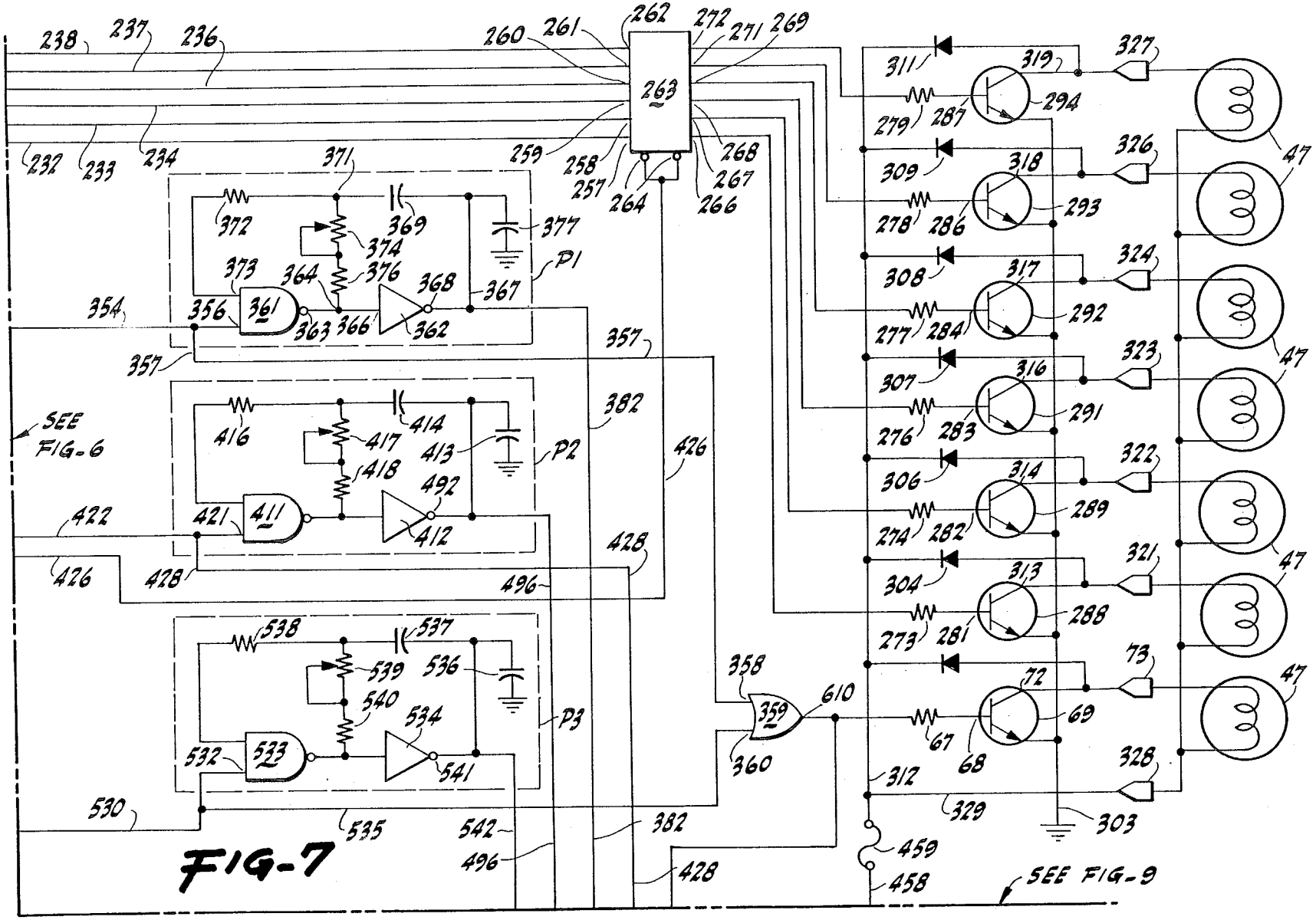
Figure 8:
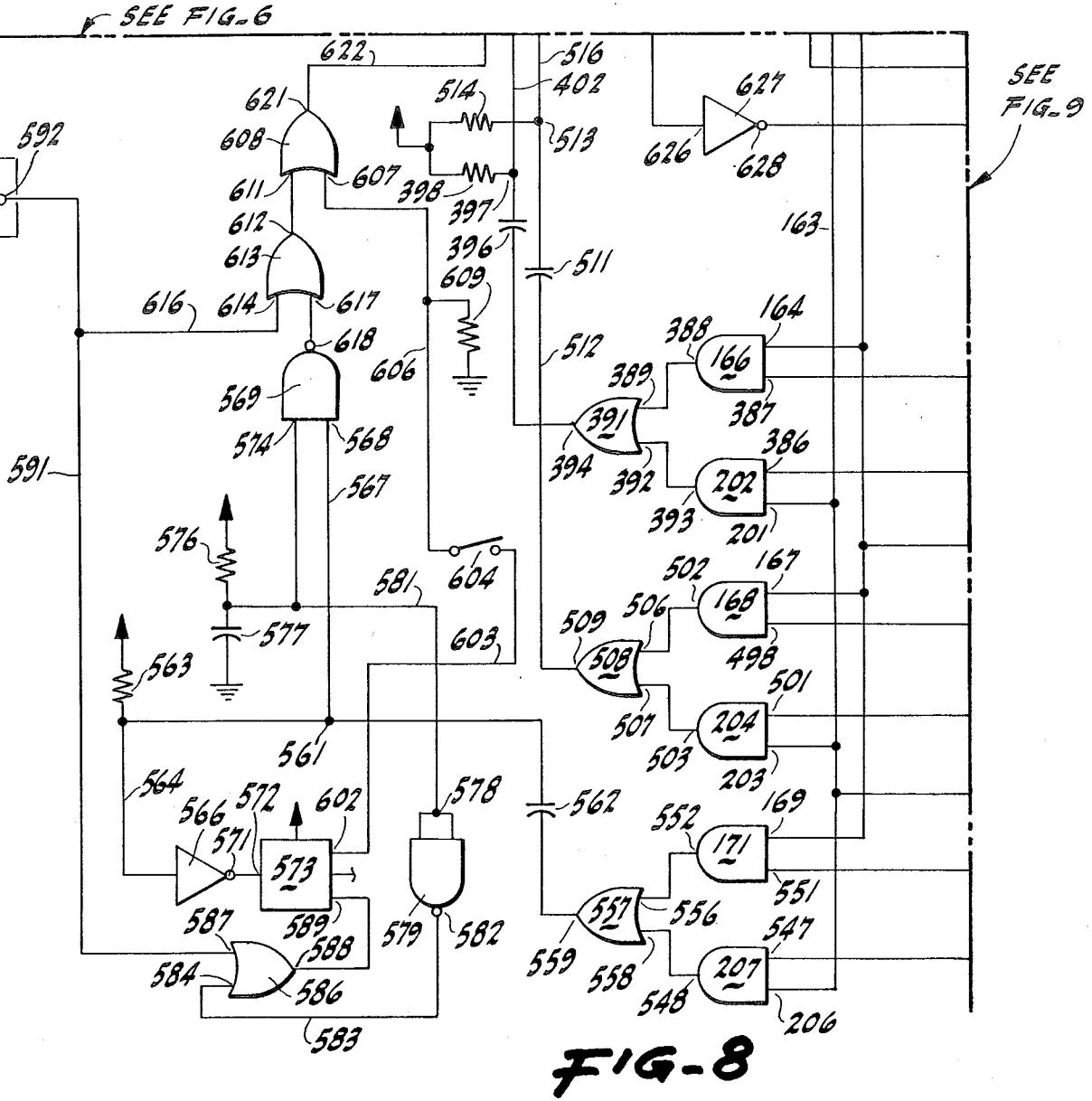

In the present instance there is provided a floor 6 on which a cabinet 7 is supported. The cabinet has a table top 8 and an upstanding back 9. For convenience, the cabinet preferably includes a basin 11 or sink appropriately plumbed for use by prospective customers in washing and cleaning empty containers they bring with them. These containers may be of any suitable sort and size but usually are of one quart and two quart sizes or of one liter and two liter sizes only, depending upon local custom. As shown in FIGS. 3 and 4, a typical container 13 has a relatively small mouth so a special funnel 14 is often furnished. Since carbonated water, when swirled, tends to lose some of the dissolved gas, the funnel is square in transverse section with straight edges 16 and flat faces 17 to inhibit swirling and to provide a smooth, relatively straight entrance of the soda water through a square spout 18 into the container.

The top 8 is provided with a arbitrary number; in the electrical diagrams, six, and in this showing, four, of identical serving stations 21, 22, 23 and 24, although the electrical connections provide for six serving stations. A description of one station applies to the others. Each station is a restricted area, usually having a mark 26 conveniently spaced from the back 9 and from the other stations and is disposed immediately and vertically below a nozzle 27. Each station is partly defined by a pair of locating walls 28 and 29 outstanding from the back 9 and spaced apart to form a converging locator for the container 13 lined up below the nozzle 27. To make sure that the nozzle is not operated unless a container is present, the wall 28 supports an optical switch or electric eye 31 effective to send a light beam 32 to a receiver 33 in the other wall 29. Unless the light beam is interrupted by a container, the machine cannot be worked at that station.

Conveniently disposed on the back 9 and near each station are manual control buttons 34, 35, 36, 37, 38 and 39. There may be corresponding indicator lights. The various control buttons are for each of six differently flavored syrups. Also provided are manual control buttons 41 and 42 preferably with corresponding indicator lights for selecting the amount (one quart or two quarts) of soda water to be dispensed and for use in starting the fluid flow. Each of the containers 44 for the flavor syrups is effective to supply syrup (by pump or by gas pressure or by gravity) through its own valve 46 controlled by its own solenoid 47 and through an individual pipe 48 to the nozzle 27.

The soda water can be supplied in either or both of two ways. Both are disclosed herein. Soda water is often supplied in a commercial tank 51 having a pressure controlling outflow valve 52 and detachably connected through a manual shutoff valve 53 to a pipe 54 leading into a pipe forming a loop 56 with a return conduit 57. The conduit 57 joins a duct 58 leading back to the pipe 54 through a pump 59 driven by a motor 61. The duct 54 is also connected to a supply tank 63 of unpressurized soda water through a manual shutoff valve 64. A refrigerator 65 cools the circulating soda water. By opening either or both of the valves 53 and 64, soda water is supplied to the loop 56 and circulation can be maintained by energizing the motor 61 to run the circulating pump 59. The loop 56 can discharge soda water through a single valve, but for simplicity of showing herein the loop 56 discharges through either of two valves 66 and 67 both opening into the nozzle 27, each schematically discharging a different selected quantity of soda water. The valve 66 has an actuating solenoid 68. When energized, this opens the valve 66 to discharge one selected amount only (say, one liter) of carbonated water. The valve 67 when its own solenoid 69 is energized discharges a different amount only (say, two liters) of carbonated water into the nozzle.

The operation of this drink maker is simple. Assuming that the supplies of flavor syrups and carbonated water are available and that electric power is connected, the device is operable. A prospective user with a container 13 of a known size approaches the cabinet and, if necessary, washes the container in the basin 11. The container is then rested on any mark 26 at any available station, such as station 21. A funnel 14 is dropped into the container and is disposed just below and in vertical line with the adjacent nozzle 27. The container is thus disposed between the walls 28 and 29 and interrupts the light beam 32, so arming the device for use. The customer selects the desired flavor of syrup and presses the corresponding one of the flavor buttons; say, button 34 for raspberry flavor. Also, according to the container size and the quantity of soda water desired, the user pushes either the button 41 (valve 66) for one quart (or liter) or pushes the button 42 (valve 67) for two quarts (or liters). If desired, the quantity button can first be pushed and then the flavor button selected can be pushed.

When one of the flavor buttons and one of the quantity buttons have both been pushed, indicator lights show which buttons have been actuated and the dispensing starts. First, a limited amount (about half) of the total amount of soda water is discharged through the valve 66, which is solenoid-opened for a set time only. The valve 66 then shuts and the appropriate valve 46 opens the raspberry syrup container 44 to the nozzle. The open time of the valve 46 is limited, so only a precise amount of flavor syrup is dispensed into the container. When the valve 46 shuts, the valve 66 is again solenoid-opened for another set time to discharge a measured further amount of soda water to the container. This second flow of soda water not only tends to clean the nozzle of any remains of the just-received syrup, but aids in drink mixing. After the second charge of soda water has been cut off, the user can remove the filled container from the target area 26 of the table. The light beam 32 is again established to make ready for a new cycle. The machine has completed a cycle and is ready for another use of the same station. The various stations can be individually and simultaneously operated and do not necessarily operate in any sequence with respect to each other.

The operation of the device is almost entirely effected by appropriate electronic circuitry and mechanism. The circuitry implements the filling of the container 13 with the two fluids, syrup and soda water, in sequence by activation of various solenoid valves controlling the flow of those fluids. In this embodiment, manual selection of the desired volume of the soda water and the desired variety of syrup causes a timed sequence of three electrically controlled events: partial filling of the container with a set amount of soda water, addition of a measured amount of syrup, and filling of the remainder of the container with a further selected amount of soda water. The presence of the container in a set location is electrically detected. The container must be in place prior to fluid delivery or delivery will not occur. Removal of the container during delivery interrupts flow of either fluid. Double filling of the container is not allowed; the container must be replaced before a subsequent filling can occur.

Figure 11:
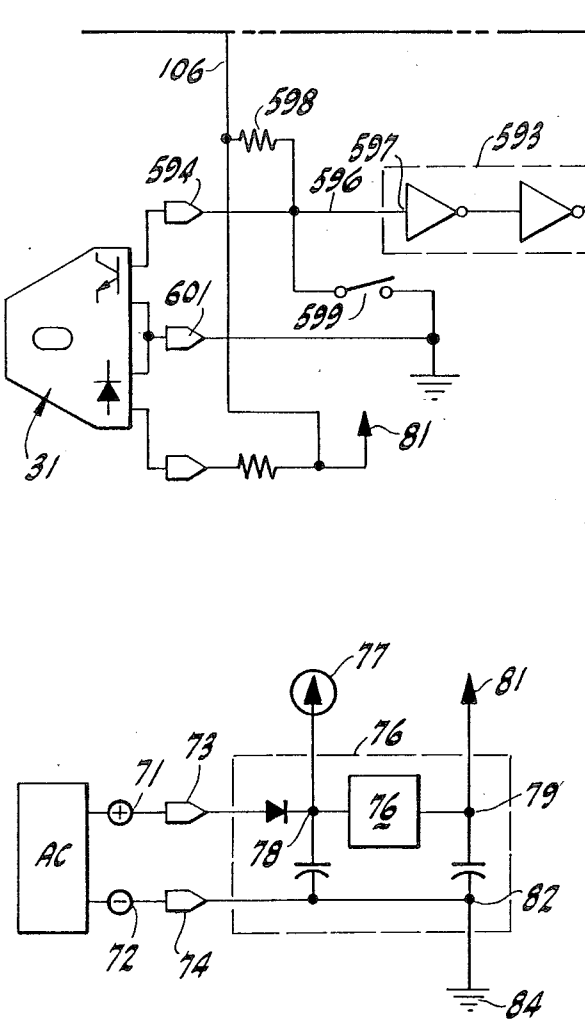
FIG. 11 is a diagram of a power supply circuit.

Electrical power for the actuating and controlling circuits is derived from the customary a.c. source AC (FIG. 11) coupled to the circuit through terminals 71 and 72 connected respectively to input terminals 73 and 74 of a d.c. power supply 76, a conventional rectifier-filter device with regulator included. Unregulated supply voltage is delivered to some of the circuit via a distribution point 77 connected to an unregulated output terminal 78 of the power supply 76. Regulated voltage is delivered to the circuit via a distribution point 79 connected to a regulated output terminal 81 of the power supply. The return path to the power supply is via a common terminal 82 connected to circuit common 84.

The chosen electrical circuit elements are low power-dissipation components or integrated circuit modules generally referred to as CMOS or COS/MOS devices. These devices are in part characterized by operation from a voltage source with polarity positive with respect to circuit common, although the functions of the control circuits may be carried out with other forms of elements.

Selection of a first fluid quantity is effected by the user's manual, momentary closure by the button 41 of an electrical contact between either a terminal lug 101 or by the button 42 of an alternative terminal lug 102 and an external circuit common terminal lug 103. The lug 101 is biased to the regulated supply voltage value through a resistor 104, one end of which connects to a regulated voltage bus 106. The other terminal of the resistor 104 connects to a conductor 107 joining the terminal lug 101 and an input terminal 108 of a Schmitt-trigger inverter 111, one of a series of similar inverters.

Attached in shunt configuration between the conductor 107 and circuit common 84 is a capacitor 109 substantially reducing electrical noise arising from external contact actions and providing an unambiguous signal to the inverter 111. The positive voltage so applied to the input of the inverter causes the inverter output voltage to be driven close to circuit common. The positive voltage is referred to as "high", or "logic high", and the voltage near common is known as "low" or "logic low". The output terminal 112 of the inverter 111 is connected via a conductor 113 to the trigger input terminal 114 of a J-K flip-flop 116.

Figures 9, 10:
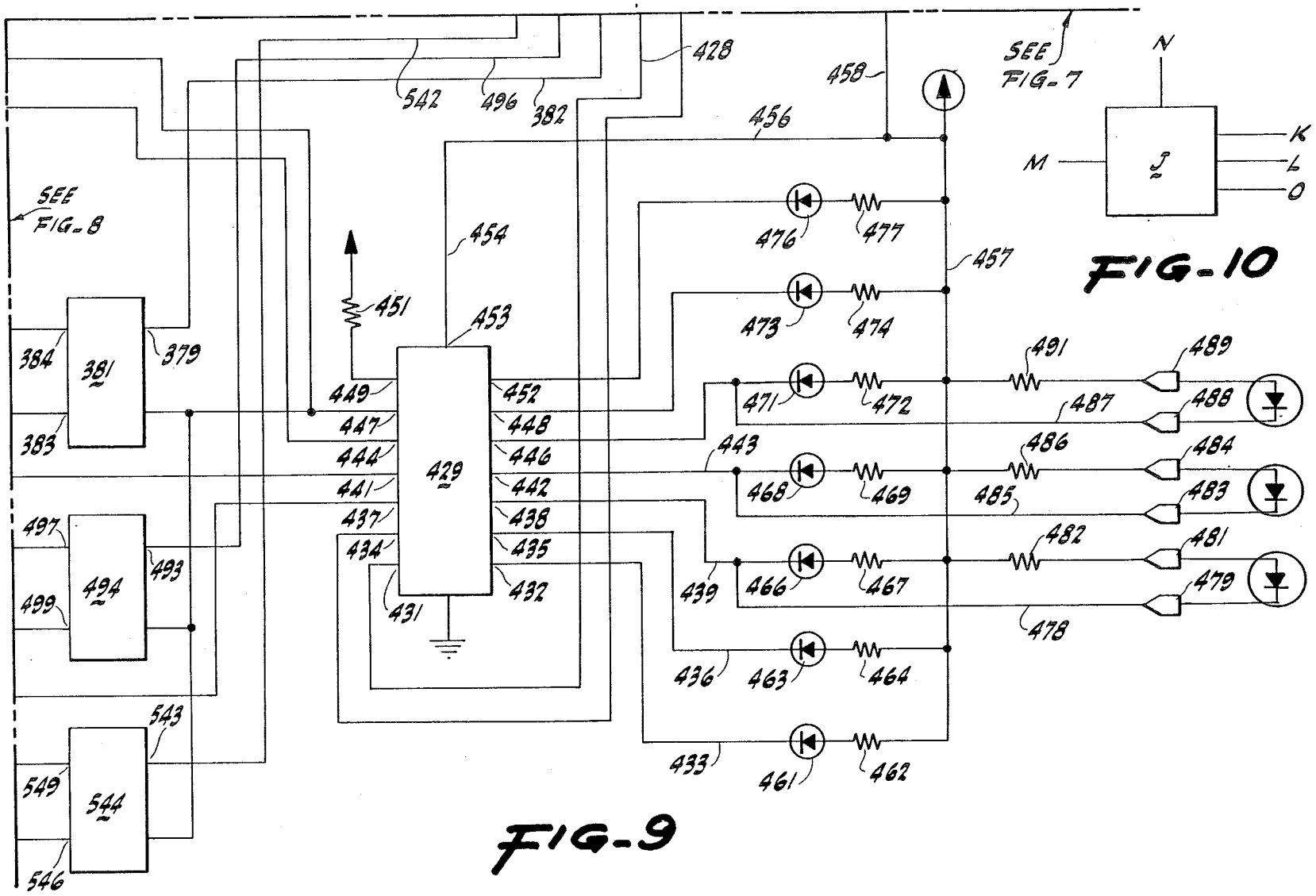
FIG. 10 is a diagram of a J-K flip-flop circuit.

An exemplary J-K flip-flop J, as especially shown in FIG. 10, alternates between two logic states, expressed as voltage levels at output terminals K and L. The alternation occurs upon application of a voltage pulse at a clock input terminal M, subject to constraint expressed as a voltage level at a conditioning input terminal N. A voltage pulse or level input to a terminal O unconditionally establishes the reference or "reset" state of the flip-flop, expressed as a logic low level at the output terminal K and a logic high level at the output terminal L. A change in logic state to the set condition is expressed as a logic high level at the terminal K and a logic low level at the terminal L. Change of state to logic high is effected by application of a voltage pulse to the clock input terminal M, if the voltage level at the conditioning terminal N is at logic high. If the voltage level at the terminal N is at logic low, no change of state will be effected; if the flip-flop is set it will stay set, and if it is reset it will stay reset.

In this device, each J-K flip-flop functions as a latching device or latch, preserving the effect of momentary closure of the switch contacts connected between the terminal lugs 101 and 103. The J-K flip-flop 116 alternates between two states, expressed as high and low, upon application of a voltage pulse to the flip-flop trigger or clock input, and upon application of high or low logic levels to the conditioning input terminal 114.

A voltage pulse delivered from the terminal 101 through the inverter 111 to trigger the input terminal 114 of the first J-K flip-flop 116 will effect a set condition at the output terminals 117 and 118 if a logic high voltage is present at the conditioning terminal 119. The combination of the resistor 104, the capacitor 109, the inverter 111 and the J-K flip-flop 116, disposed and connected as described, forms what is termed "latch A". This is one of several similar "latches" or latching circuits acting to preserve momentary contact closure information. A second latch B is comprised of the terminal lug 102, a resistor 121, a capacitor 122, an inverter 123, and a J-K flip-flop 124. A third latch C is comprised of a terminal lug 126, a resistor 127, a capacitor 128, an inverter 129, and a J-K flip-flop 131. A fourth comparable latch D is comprised of a terminal lug 132, a resistor 133, a capacitor 134, an inverter 136, and a fourth J-K flip-flop 137. A fifth latch E is comprised of a terminal 138, a resistor 139, a capacitor 141, an inverter 142, and a fifth J-K flip-flop 143. A sixth latch F is comprised of a terminal lug 144, a resistor 146, a capacitor 147, an inverter 148, and a J-K flip-flop 149. A seventh latch G is comprised of a terminal lug 151, a resistor 152, a capacitor 153, an inverter 154, and a J-K flip-flop 156. An eighth latch H is comprised of a terminal lug 157, a resistor 158, a capacitor 159, an inverter 161, and a J-K flip-flop 162.

The output terminal 117 of the latch A is connected via a conductor 163 to an input terminal 201 of an AND gate 202, to the input terminal 203 of an AND gate 204, and to the input terminal 206 of an AND gate 207. In addition, a terminal 172 of a capacitor 173 connects to the conductor 163. The other terminal 174 of the capacitor 173 connects to an input terminal 176 of an OR gate 177. Connected between the junction of the capacitor terminal 174, the input terminal 176 of the OR gate 177 and circuit common 84 is a resistor 179. The combination of the capacitor 173 and the resistor 179 forms a network permitting the positive-going transient of output voltage from the output terminal 117 of the latch A to pass via an output terminal 181 of the OR gate 177 and a conductor 182 to a reset input 183 of the latch B. Thus, one consequence of setting the latch A is to reset the latch B.

An output terminal 192 of the latch B is connected via a conductor 193 to an input terminal 164 of an AND gate 166, to an input terminal 167 of an AND gate 168, and to an input terminal 169 of an AND gate 171. Additionally, one terminal 194 of a capacitor 196 is connected at a junction 195 to the output terminal 192 of the latch B. The other terminal 190 of the capacitor 196 connects to a second input terminal 197 of an OR gate 208. Output voltage from that OR gate 208 is delivered via a conductor 212 to a reset input terminal 211 of the latch A. Connected in shunt between an input terminal 197 of the OR gate 208 and circuit common is a resistor 199. Circuit action for this combination of capacitor 196 and resistor 199 is as described for the capacitor 173 and the resistor 179, resetting latch A when latch B is set.

The second, complementary, output terminal 118 of latch A is connected to a first input terminal 184 of a NAND gate 186. A second input terminal 187 of the NAND gate 186 is connected via a conductor 188 to the complementary output terminal 189 of latch B. If both latches A and B are in their reset or reference state, both complementary output voltages will be at logic high, effecting a logic low state at an output terminal 191 of the NAND gate 186. If either latch A or latch B is triggered to its set state, the output voltage at the output terminal 191 of the NAND gate 186 will rise to logic high. The terminal 191 of the NAND gate 186 is connected via a conductor 213 to a first input terminal 214 of an AND gate 216.

The conditioning terminal 119 of latch A is connected to a conditioning terminal 120 of latch B and thence via a conductor 217 to a second input terminal 218 of the AND gate 216, an input terminal 219 of an inverter 221, and to an output terminal 222 of a six-input NOR gate 223. If the voltage at the output terminal 222 of the NOR gate 223 is at logic high, either the latch A or the latch B will, when triggered, enter into its set state, driving the other into its reset state. If the triggered latch is already in its set state, it will remain there. If the output voltage on the output terminal 222 of the NOR gate 223 is at logic low level, trigger pulses into either the latch A the latch B will have no effect.

NOR gate 223 input terminals 224, 226, 227, 228, 229 and 231 are connected respectively via conductors 232, 233, 234, 236, 237 and 238 to output terminals 239, 241, 242, 243, 244 and 246 of the latches C, D, E, F, G and H. If any one of the latches C through H is in the set state, voltage at the output terminal 222 of the NOR gate 223 will be at logic low, inhibiting any response of either latch A or latch B to input triggers. Furthermore, voltage appearing at the output terminal 222 of the NOR gate 223 appears also at the second input terminal 218 of the AND gate 216, affecting the voltage level at an output terminal 247 of the AND gate 216 in the following manner: if either latch A or latch B is set and none of the latches C through H is set, the voltage will be at logic high. If neither latch A nor latch B is set, or, if any of the latches C through H is set, voltage at the output terminal 247 will be at logic low. Connected to the terminal 247 of the AND gate 216 via a conductor 248 are conditioning input terminals 249, 251, 252, 253, 254 and 256 of the latches C, D, E, F, G and H. Thus, if neither latch A nor latch B is set, or if any of latches C through H is set, any further change in state of latches C through H is prevented.

The conductors 232, 233, 234, 236, 237 and 238, originating at the respective output terminals 239, 241, 242, 243, 244 and 246 of the latches C, D, E, F, G and H, terminate at terminals 257, 258, 259, 260, 261 and 262 of a six-channel buffer amplifier 263. The amplifier 263 has an additional enabling input at a terminal 264. The voltage output from a selected latch will appear at an input terminal of the amplifier 263 and, if voltage at the enabling input terminal is at a logic low level, will cause a comparable voltage with a larger current capacity to appear at the one of the output terminals 266, 267, 268, 269, 271 or 272 corresponding to the active input terminal. The output terminals 266, 267, 268, 269, 271 and 272 of the buffer amplifier 263 are respectively coupled via series resistances 273, 274, 276, 277, 278 and 279 to the base elements 281, 282, 283, 284, 286 and 287 of transistors 288, 289, 291, 292, 293 and 294. Emitter elements 296, 297, 298, 299, 301 and 302 of the respective transistors are connected to circuit common 84 via a conductor 303. Transient suppressing diodes 304, 306, 307, 308, 309 and 311 are connected with their cathodes to an unregulated supply voltage bus 312 and with their anodes to the respective collector elements 313, 314, 316, 317, 318 and 319 of these transistors. Also connected respectively to the respective collector elements 313, 314, 316, 317, 318 and 319 of these transistors are terminal lugs 321, 322, 323, 324, 326 and 327. A further terminal lug 328 is joined via a conductor 329 to the unregulated supply voltage conductor 312. An external device, such as a solenoid, connected between any one of the terminal lugs 321, 322, 323, 324, 326 or 327 and the terminal lug 328 has power applied to it when the appropriate latch circuit is activated and the buffer amplifier 263 is enabled.

The buffer amplifier 263 is enabled via the terminal 264 when a J-K flip-flop 341 is triggered to its set state as one consequence of a timing sequence originated upon setting of any one of the latches C through H in the following manner. When voltage at the input terminal 219 of the inverter 221 falls in response to the setting of any one of the latches C through H, the voltage at the output terminal 346 rises to logic high level. The terminal 346 is connected via a conductor 347 to trigger an input terminal 348 of a J-K flip-flop 349, effecting the set state of the J-K flip-flop 349, inasmuch as a conditioning input terminal 351 is held at the logic high level by virtue of its connection via a conductor 352 to the regulated supply voltage. An output terminal 353 connects via a conductor 354 to an input terminal 356 of a two-input NAND gate 361. The output terminal 353 of the J-K flip-flop 349 is further connected to a first input terminal 358 of an OR gate 359. The two-input NAND gate 361 is one of two active elements in the first of three gated voltage pulse train generators $P_1$, $P_2$ and $P_3$. The first generator, $P_1$, is connected with an inverter 362, an output terminal 363 on the gate 361 being joined to a junction 364 itself connected to a terminal 366 of the inverter. A conductor 367 joins the output terminal 368 of the inverter to one lead of a capacitor 369, the other lead of the capacitor 369 being connected to a junction 371. A resistor 372 is connected between junction 371 and a second input 373 of the two-input NAND gate 361. Connected between the junction 371 and the output terminal 363 is a series combination of a variable resistor 374 and a fixed resistor 376. A smoothing capacitor 377 is connected between the conductor 367 and circuit common. Output voltage from the pulse train generator $P_1$ is taken from the output terminal 368 of the inverter 362. The frequency of pulses in the train may be varied by adjustment of the variable resistor 374. The basic pulse rate is set by selection of appropriate values of the capacitor 369 and the resistors 374 and 376.

Pulse train generators of this nature are described in the literature. For example, such a circuit is shown on page 531 of an RCA Corporation publication titled "COS/MOS Integrated Circuits", SSD 203C, 1975. To summarize the action of the pulse train generator, it is to be noted that an enabling voltage from the J-K flip-flop 349 applied to the input terminal 356 of the NAND gate 361 causes a train of voltage pulses to appear at the output terminal 368 of the inverter 362. Removal of an enabling voltage from the input terminal 356 of the NAND gate 361 stops generation of the train of voltage pulses.

Voltage pulses from the output terminal 368 of the pulse train generator $P_1$ are conducted to an input terminal 379 of a first binary ripple counter 381 via a conductor 382. The ripple counter 381 accumulates pulse counts, producing a voltage change from logic high to logic low at an output terminal 383 when a specified number of counts has been accumulated. A similar fall in voltage level from logic high to logic low occurs at an output terminal 384 of the counter 381 when twice the number of counts required for action at the output terminal 383 has been accumulated. The output terminal 383 of the counter 381 is connected to a second input terminal 386 of the two-input AND gate 202. The output terminal 384 of the counter 381 is connected to a second input terminal 387 of the two-input AND gate 166. An output terminal 388 of the AND gate 166 is connected to an input terminal 389 of a two-input OR gate 391. A second input terminal 392 of the OR gate 391 is connected to an output terminal 393 of the AND gate 202. Prior to accumulation of specified counts in the counter 381, and subsequent to setting the input latch A, a logic high voltage level will appear at the output terminal 393 of the AND gate 202, effecting a logic high voltage level through the OR gate 391 at its output terminal 394.

When the specified number of counts has been accumulated in the first counter 381, the voltage fall from logic high to logic low will be transmitted to the output terminal 394 of the OR gate 391, either via the output terminal 383 of the counter 381 and the AND gate 202 if the input latch A has been set, or via the output terminal 384 of the counter 381 and the AND gate 166 if the input latch B has been set.

The voltage fall is transmitted through a capacitor 396 connected between the output terminal 394 of the OR gate 391 and a junction 397. A resistor 398 is connected between the junction 397 and the regulated supply voltage and acts in conjunction with the capacitor 396 to ensure that only a voltage fall is transmitted from the junction 397 to the input terminal 399 of an inverter 401 via a conductor 402. The inverter 401 serves to invert the sense of the voltage appearing at the inverter input, in this case a voltage pulse extending from logic high level to logic low level. The positive output pulse appearing at an output terminal 403 of the inverter 401 couples firstly to a first input terminal 404 of an OR gate 406 via a conductor 407, and secondly to trigger an input terminal 408 of the J-K flip-flop 341. From the first input terminal 404 of the OR gate 406 the positive voltage pulse is transmitted through the OR gate 406 to a reset input terminal 409 of the J-K flip-flop 349 of the first pulse train generator, effecting a reset of the flip-flop 349 and terminating generation of the first pulse train. In addition, the logic high voltage level appearing at the output terminal 353 of the J-K flip-flop 349 and transmitted through the OR gate 359 falls to logic low level, removing drive current from the transistor 69 and inactivating any device connected between the terminals 73 and 328.

The second gated pulse train generator $P_2$ is constituted of a NAND gate 411, an inverter 412, capacitors 413 and 414, and resistors 416, 417 and 418, disposed as described for the first gated pulse train generator $P_1$. Connected to an enabling input terminal 421 of the second pulse train generator $P_2$ via a conductor 422 is output terminal 423 of the J-K flip-flop 341. By virtue of the conditioning terminal 394 being connected to the regulated supply voltage, the effect of a positive voltage pulse appearing at the output terminal 403 of the inverter 401 is to establish the set state of the J-K flip-flop 341, thereby effecting two actions: first, the second gated pulse train generator $P_2$ is started, and, second, the buffer amplifier 263 is enabled. That is by virtue of logic low voltage level appearing at the output terminal 424 of the J-K flip-flop 341, and being transmitted through a conductor 426 to the enabling terminal 264 of the buffer amplifier 263. Current is so caused to flow in one of said output transistors 288, 289, 291, 292, 293 or 294, corresponding to the selected latch C, D, E, F, G or H, for the time the second pulse train generator $P_2$ is operating.

The voltage pulse train appearing at the output terminal 492 of the second gated pulse train generator $P_2$ is led to an input terminal 493 of a second counter 494 via a conductor 496. The output terminal 497 of the counter 494 connects to a second input terminal 498 of the AND gate 168. An output terminal 499 connects to a second input terminal 501 of the AND gate 204. The output terminals 502 and 503, respectively, of the AND gates 168 and 204 connect to first and second input terminals 506 and 507 of an OR gate 508. An output terminal 509 of the OR gate 508 connects to one lead of a capacitor 511 via a conductor 512. The other lead of the capacitor 511 connects to a junction 513. A resistor 514 is connected between the junction 513 and the regulated supply voltage. This resistor-capacitor combination has the same function as the resistor 398 and capacitor 396 combination, to transmit a negative voltage pulse from the second counter 494 upon completion of an appropriate number of counts. The negative voltage pulse appearing at the junction 513 is transmitted via a conductor 516 to an inverter 517. The positive voltage pulse appearing at the output terminal 518 of the inverter 517 is transmitted to a first input terminal 521 of an OR gate 522 and thence via an output terminal 523 of the OR gate 522 and a conductor 524, to the reset input terminal 427 of the J-K flip-flop 341, terminating pulse generation from the second gated pulse train generator.

The output terminal 518 of the inverter 517 is connected to trigger the input 526 of a J-K flip-flop 527. An output terminal 529 of the J-K flip-flop 527 connects via a conductor 531 to an input terminal 532 of a two-input NAND gate 533. Additional connection from the output terminal 529 of the J-K flip-flop 527 is made via a conductor 535 to the input terminal 360 of the OR gate 359, enabling, when said J-K flip-flop 527 is set, current to flow in the transistor 69, actuating the soda solenoid connected between the terminals 73 and 328. The NAND gate 533, in combination with an inverter 534, capacitors 536 and 537, and resistors 538, 539 and 540 disposed and connected just as previously described for the first gated pulse train generator $P_1$, form the third gated pulse train generator $P_3$. An output terminal 541 of the inverter 534 and of the third pulse train generator is connected via a conductor 542 to an input terminal 543 of a pulse counter 544. The first output terminal 546 of the third pulse counter 544 is connected to a second input terminal 547 of the AND gate 207. Voltage changes appearing at the input terminal 547 of the AND gate 207 will appear at an output terminal 548 of the AND gate 207 if the voltage at the input terminal 206 of the AND gate 207 is at logic high level by virtue of the input latch A having been set. A second output terminal 549 of the third counter 544 is connected to a second input terminal 551 of the AND gate 171. Voltage changes appearing at the input terminal 551 of the AND gate 171 will appear at an output terminal 552 of the AND gate 171 if voltage at the input terminal 169 of the AND gate 171 is at logic high level by virtue of the input latch B having been set. The output terminal 552 of the AND gate 171 connects to a first input terminal 556 of an OR gate 557. A second input terminal 558 of the OR gate 557 connects to the output terminal 548 of the AND gate 207. Voltage changes at either of the input terminals 556 or 558 will appear at an output terminal 559 of the OR gate 557.

Connected between the output terminal 559 of the OR gate 557 and a junction point 561 is a coupling capacitor 562. The junction point 561 is biased to the regulated supply voltage value by virtue of a resistor 563 connected between the junction point 561 and the regulated supply voltage. Here again the positive voltage bias allows onl negative voltage pulses to be passed from the junction point 561 via a conductor 564 to an inverter 566, and via a conductor 567 to a first input terminal 568 of a NAND gate 569.

A second input terminal 574 of the NAND gate 569 is connected through a resistor 576 to the regulated supply voltage. A bypass capacitor 577 is also connected between the second input terminal 574 of the NAND gate 569 and circuit common. This affords a logic high level bias to the second input terminal 574 of the NAND gate 569 that is free from electrical disturbances. This same logic high level bias is applied to an input terminal 578 of a NAND gate 579 via a conductor 581 joining the input terminal 574 of the NAND gate 569 with the input terminal 578 of the NAND gate 579, which operates in this case as an inverter, supplying a logic low level voltage from its output terminal 582 via a conductor 583 to a first input terminal 584 of an OR gate 586.

A positive voltage pulse appearing at an output terminal 571 of the inverter 566 as a result of the third counter having reached its count is delivered to a trigger input terminal 572 of a J-K flip-flop 573. This J-K flip-flop will attain a set state as the result of a trigger pulse if a reset terminal 589 is not being held at logic high level by voltage appearing at an output terminal 588 of the OR gate 586. Voltage appearing at an input terminal 587 of the OR gate 586 is delivered via a conductor 591 from an output terminal 592 of a non-inverting logic buffer amplifier 593. An input terminal 597 of the buffer amplifier 593 connects to a terminal lug 594 via a conductor 596. In addition, a resistor 598 is connected between the conductor 106 and the conductor 596, providing a logic high level bias voltage to the terminal lug 594 and the input terminal 597 of the buffer amplifier 593.

One pole of a switch 599 is joined to the conductor 596 and the other pole is joined to circuit common. This affords an in-circuit test of the action of the optically activated switch 31 connected between the terminal lugs 594 and 601. When either the switch 599 or the optical switch contacts are closed, the logic level high bias voltage appearing at the reset terminal 589 of the J-K flip-flop 573 is brought to logic low level value. This affords an opportunity for the J-K flip-flop 573 to act. When the switch 599 and the optical switch 31 joined to the terminal lugs 594 and 601 are both open, the voltage at the reset terminal 589 of the J-K flip-flop 573 is at logic high level, inhibiting action of the J-K flip-flop 573.

The logic state of the J-K flip-flop 573 is conveyed from an output terminal 602 via a conductor 603, a switch 604, and a conductor 606 to a first input terminal 607 of an OR gate 608. A resistor 609, connected between the first input terminal 607 of the OR gate 608 and circuit common, establishes a logic low voltage level at the terminal 607 when the switch 604 is open. A second input terminal 611 of the OR gate 608 is connected to an output terminal 612 of a two-input OR gate 613. A first input terminal 614 of the OR gate 613 connects through a conductor 616 to the conductor 591. A second input terminal 617 of the OR gate 613 connects to an output terminal 618 of the NAND gate 569.

A logic level high voltage appearing at an output terminal 621 of the OR gate 608 constitutes a circuit reset command. The command may be either of a continuous or pulsed nature. A steady, continuous command results from closure of the switch 599 or an equivalent connection between the lugs 594 and 601. Alternatively, if the switch 604 is closed, from the J-K flip-flop 573 toggling to its set state, a reset pulse is delivered to the output terminal 621 of the OR gate 608 when the third counter reaches the end of its count. This end-of-count reset pulse also serves to toggle the J-K flip-flop 573 to its set state if either the switch 599 is closed or circuit closure is effected between the terminals 594 and 601. Thus, with the switch 604 closed, the reset command is a pulse, followed by a steady logic high level that is removed only by opening of the circuit between the terminals 594 and 601, and subsequent reclosure of the circuit or the switch 599.

The output terminal 621 of the OR gate 608 is connected, via a conductor 622 and branches therefrom, to a second input terminal 198 of an OR gate 208; to a second input terminal 178 of an OR gate 177; to the second input terminal 520 of the OR gate 522; to a second input terminal 405 of an OR gate 406; to reset terminals 631, 632, 633, 634, 636 and 637 of the respective input latches C, D, E, F, G and H; to a reset terminal 530 of the J-K flip-flop 527; to the reset terminal of each of the first, second and third counters 381, 494 and 544; to an input terminal 447 of a seven-channel power driver 429; and to an input terminal 626 of an inverter 627. Reset of the entire device is so effected.

A status monitor for this device is specially provided and is comprised of a seven-channel power amplifier 429, having as input signals a regulated power supply voltage connected through an isolating resistor 451 to a first input terminal 449. The reset command is connected to the second input terminal 447, and a ready signal from an output terminal 628 of the inverter 627 is connected to a third input terminal 444. Indication of high volume selection is from a conductor 193 having a branch to a fourth input terminal 441, while low volume selection is from a conductor 163 having a branch to a fifth input terminal 437. First fluid delivery is noted from the output terminal 610 of the OR gate 359 through a conductor to a terminal 434, and second fluid delivery from the conductor 422 of the second pulse train generator is carried by a conductor to a seventh input terminal 431. Corresponding output terminals 452, 448, 446, 442, 438, 435 and 432 connect to series-connected combinations of light-emitting diodes 476, 473, 471, 468, 466, 463 and 461 respectively joined to resistors 477, 474, 472, 469, 467, 464 and 462 and making their remaining connections to the unregulated supply voltage via a conductor 457.

In addition, monitoring external to the device is afforded via a terminal lug 488 connected to the third output terminal 446 and via a terminal lug 489 connected through a current limiting resistor 491 to the unregulated supply voltage, the lugs 488 and 489 serving to convey the "ready" indication by a light. A terminal lug 483 is connected by a lead 485 to the fourth output terminal 442, and a paired terminal lug 484 is connected through a current limiting resistor 486 to the unregulated supply voltage, serving to afford the "high volume" indication. A terminal lug 479 is connected by a conduit 478 to the fifth output terminal 438, and a terminal lug 481 is connected through a current limiting resistor 482 to the unregulated supply voltage, in order to convey the low volume indication. The external monitors may be visual indicators such as incandescent lamps, or light-emitting diodes, or they may be audible devices, or both.

Prerequisite to all actions is circuit closure and maintenance to power source AC. Once this closure is effected, response action is initiated by manual momentary circuit closure between terminal pairs 101 and 103 or pairs 102 and 103, setting either input latch A or input latch B to select either low or high volume delivery of soda water. Alternate momentary closures of these volume selection contacts will cause alternate selection of the delivery volume of the first fluid (water), but only if the second fluid (syrup) has not yet been selected. Following selection of the desired volume of the first fluid, input latches C through H are armed. Momentary manual closure of any circuit between the circuit common terminal lug 103 and a selected one of the terminal lugs 126, 132, 138, 144, 151 or 157 will cause the appropriate input latch to be set, effecting selection of the chosen second fluid (flavor syrup) and inhibiting subsequent circuit action upon later closure of any of the second fluid selection circuits.

Closing of any one of the second circuits also effects the start of the first pulse train generator $P_1$ and the start of delivery of the first portion of the first fluid to the container in place. Delivery of the first portion of the soda water continues until sufficient or a predetermined number of counts have been accumulated in the first counter 381. When that count has been reached, an output pulse from the counter 381 stops the first pulse train generator as well as delivery of the first portion of soda water. The same output pulse also starts the second pulse train generator $P_2$ and delivery of the second fluid or chosen syrup. When sufficient counts have been accumulated in the second counter 494, an output pulse therefrom stops the second pulse train generator, stops delivery of the second fluid, and starts the third pulse train generator $P_3$, effecting start of delivery of the second portion of the first fluid. Upon accumulation of sufficient counts in the third counter 544, an output pulse is generated and propagated throughout the circuit, returning all flip-flops to their quiescent state and halting delivery of fluid.

Whether or not any action is initiated by circuit closures of fluid selectors is determined by the status of a switch, the photo switch 600, external to the circuit and connected between terminal lugs 594 and 601. Several conditions must be met before the entire program of fluids will be delivered to a container. First, the container must be properly in place or on target prior to and throughout delivery. If the receiver vessel is removed part way through delivery, the photo switch causes the reset state of the circuit to be entered and to stop all delivery. Second, if delivery has been completed and the receiver vessel has not been replaced, no further delivery of fluid will ensue.

Pulse train generators $P_1$, $P_2$ and $P_3$ and associated counters 381, 494 and 544 form a control for the dispensation of fluids, according to a program and having time as the variable under control. Resistors 374, 417 and 539 adjust the pulse rate of each of the pulse rate generators and so the time of dispensation. Accumulation of a fixed number of counts in a particular counter takes less time with a higher rate. Thus, indirectly, the volumes of fluids dispensed may be adjusted by adjustment of the pulse rates of the counters.

Thus, it is seen that an electronic network responds to the user's selections and operates to sensors and electromagnetic valves to dispense the selected syrup and charges of soda water into a container, the presence of which is essential.

I claim:

1. A soft drink maker comprising a counter having a dispensing station adapted to support a container, a nozzle on said counter spaced above and arranged to discharge downwardly toward said container at said station, means for supplying and controlling water to said nozzle, locator means on said counter including a pair of converging locating side walls defining a container locator, said converging walls configured to abut the sides of said container for positioning said container relative to said station and said nozzle, optical sending and receiving means recessed within said locating walls for establishing a beam between said walls in a position interruptable by said container, a manual control, and means concurrently controlled by said manual control and said optical sending and receiving means for operating said water supplying and controlling means.

2. A device as in claim 1 including means for concurrently operating said water controlling means during a single cycle of a selectable duration, and means for interrupting said cycle prior to the end of said duration upon removal of said opaque container from a position between said sender and said receiver.

* * * * *